United States Patent [19]

Eaby et al.

[11] 4,437,725

[45] Mar. 20, 1984

[54] JUNCTION CONNECTIONS FOR MODULAR WIRING SYSTEMS

[75] Inventors: Daniel G. Eaby, Mt. Joy; William B. Long, Camp Hill; John R. Shuey, Carlisle, all of Pa.

[73] Assignee: AMP Incorporated, Harrisburg, Pa.

[21] Appl. No.: 249,518

[22] Filed: Mar. 31, 1981

[51] Int. Cl.[3] ..... H01R 13/514

[52] U.S. Cl. ..... 339/156 R; 339/205

[58] Field of Search ..... 339/154 R, 154 L, 154 A, 339/156 R, 156 T, 204, 205

[56] References Cited

U.S. PATENT DOCUMENTS

| | | | |
|---|---|---|---|
| 4,146,287 | 3/1979 | Jonsson | 339/75 M |
| 4,153,326 | 5/1979 | Frantz et al. | 339/99 R |
| 4,219,868 | 8/1980 | Bowman et al. | 362/147 |
| 4,219,869 | 8/1980 | Bowman et al. | 362/147 |
| 4,249,789 | 2/1981 | Lee | 339/156 R |
| 4,313,646 | 2/1982 | Millhimes et al. | 339/156 R |

*Primary Examiner*—Howard N. Goldberg
*Attorney, Agent, or Firm*—Adrian J. LaRue

[57] ABSTRACT

A junction connector and a tap connector for a modular wiring system are disclosed. The junction connector has oppositely directed faces which receive cable connectors on the ends of the distribution cables of the system. Feed-through conductors in the junction connector are mated directly with terminals in the cable connectors. The tap connector is dimensioned to be mounted in a standard circular hole in a panel and has a mating face which is against a tap connector receiving face of the junction connector when the parts are mated. The terminals in the tap connector are arranged as a non-linear cluster in order that they might be all contained within the cylindrical tap connector housing. The feed-through conductors in the junction connector are in side-by-side coplanar relationship. The tap conductors which extend from the feed-through conductors to the tap terminals are rigid members, some of which have intermediate laterally extending portions to provide the transition to the cluster of terminals in the tap connector. These intermediate portions are received in recesses in the junction connector housing.

15 Claims, 8 Drawing Figures

2
4
6
6'
8
8'
10
12
14
16'
18
22
104
106
148
150
152
154
156
158
160
162
164
165
166'
168
170
172
174
176
178

JUNCTION CONNECTIONS FOR MODULAR WIRING SYSTEMS

FIELD OF THE INVENTION

This invention relates to junction connectors and tap connectors for modular wiring systems of the type composed of cables having cable connectors on their ends and junction and tap connectors for providing tap connections to the cables. The embodiment of the invention disclosed herein is particularly intended for use in a system including cable connectors of the type disclosed and claimed in application Ser. No. 233,543 filed Feb. 11, 1981.

BACKGROUND OF THE INVENTION

It is becoming increasingly common to provide wiring for power distribution in buildings by means of modular or plug-together wiring systems, one such system being described in U.S. Pat. No. 4,146,287. A typical modular wiring system comprises distribution cables having cable connectors on their ends, junction connectors, and tap connectors. The cable connectors can be mated with each other and with the junction connectors when it is desired to provide a power outlet for lighting or other purposes. A tap connector is also mated with each junction connector when an outlet or power source is required so that the tap wires are connected to the distribution wires in the cables.

The economies and convenience which can be realized from the use of modular wiring systems depend in a large part upon the degree of standardization which can be achieved among the connectors and terminals used in the connectors in the system and upon the cost of the connectors. Many existing modular wiring systems require an excessive number of different parts for the system and the need for an excessive number of parts defeats, to some extent at least, the purpose of the system. For example, some systems presently being used require distinctly different types of cable connectors, one type being dimensioned and designed such that it can be mated only with the input side of the junction connector and the other type of cable connector being designed such that it can be mated only with the output side of the junction connector. In some systems, the cable connectors and the junction connector are relatively complex in that they are made up of a molded insulated housing, a metallic shell surrounding the housing, and conductors within the housing which are composed of several parts such as individual terminals crimped onto the ends of stamped feed-through conductors and tap conductors which must be connected by individual crimped connections to the feed-through conductors in the junction connector housing. It would be desirable to reduce the complexity of some of the existing connectors used in modular wiring system without sacrifice of the convenience, safety, and versatility of the system and the present invention is accordingly directed to the achievement of improved junction and tap connectors which are of relatively simple construction.

It is common practice in the manufacture of partition panels for buildings, electrical junction boxes, and fluorescent lighting fixtures, to provide circular holes or circular knock-out plugs of a standard diameter in the parts at locations where wires must pass through the panels. Most of the presently available modular wiring systems have tap connectors, that is connectors for making tap connections to the distribution cables, which are of rectangular cross-section and these tap connectors cannot therefore be conveniently mounted in the circular openings in, for example, an overhead fluorescent lighting fixture. As a result, it is necessary to either provide non-standard openings in the lighting fixture or to use some sort of adaptor between the circular opening in the panel and the rectangular tap connector of the modular wiring system. The present invention in accordance with a further aspect thereof is directed to the achievement of a tap connector comprising a circular housing which can be mounted in a standard circular panel opening and which can also be used with a junction connector having feed-through conductors therein which are in side-by-side parallel relationship, an arrangement which offers the greatest convenience for junction connectors and cable connectors in modular wire systems.

A preferred embodiment of the invention comprises an all plastic junction connector housing assembly having oppositely directed cable connector receiving faces and having side-by-side parallel feed-through conductors therein extending between the cable connector receiving faces. The tap connector comprises a generally cylindrical housing which can be fitted into a circular panel opening of standard dimensions and it has a generally circular mating face which is against a mating face of the junction connector when the two connectors are coupled. The contact terminals in the tap connector are arranged as a non-linear cluster in order that they might all be fitted within the cylindrical housing of the tap connector. Tap connector conductors in the junction connector extend from the feed-through conductors to the tap connector receiving face of the junction connector housing and one or more of these tap conductors extend laterally so that the terminal portions on their ends will also be arranged as a cluster. The tap conductors and the feed-through conductors in the junction connector housing are rigid members which can be easily assembled to the housing and selectively connected to each other to provide the desired tap connections to the distribution conductors in the distribution cables of the system.

DESCRIPTION OF THE DRAWING

FIG. 6 is a cross-sectional view looking in the direction of the arrows 6—6 of FIG. 1, showing cable connectors mated with a junction connector and showing the junction connector mated with a tap connector mounted in a panel.

PREFERRED EMBODIMENT OF THE INVENTION

Figure 1:
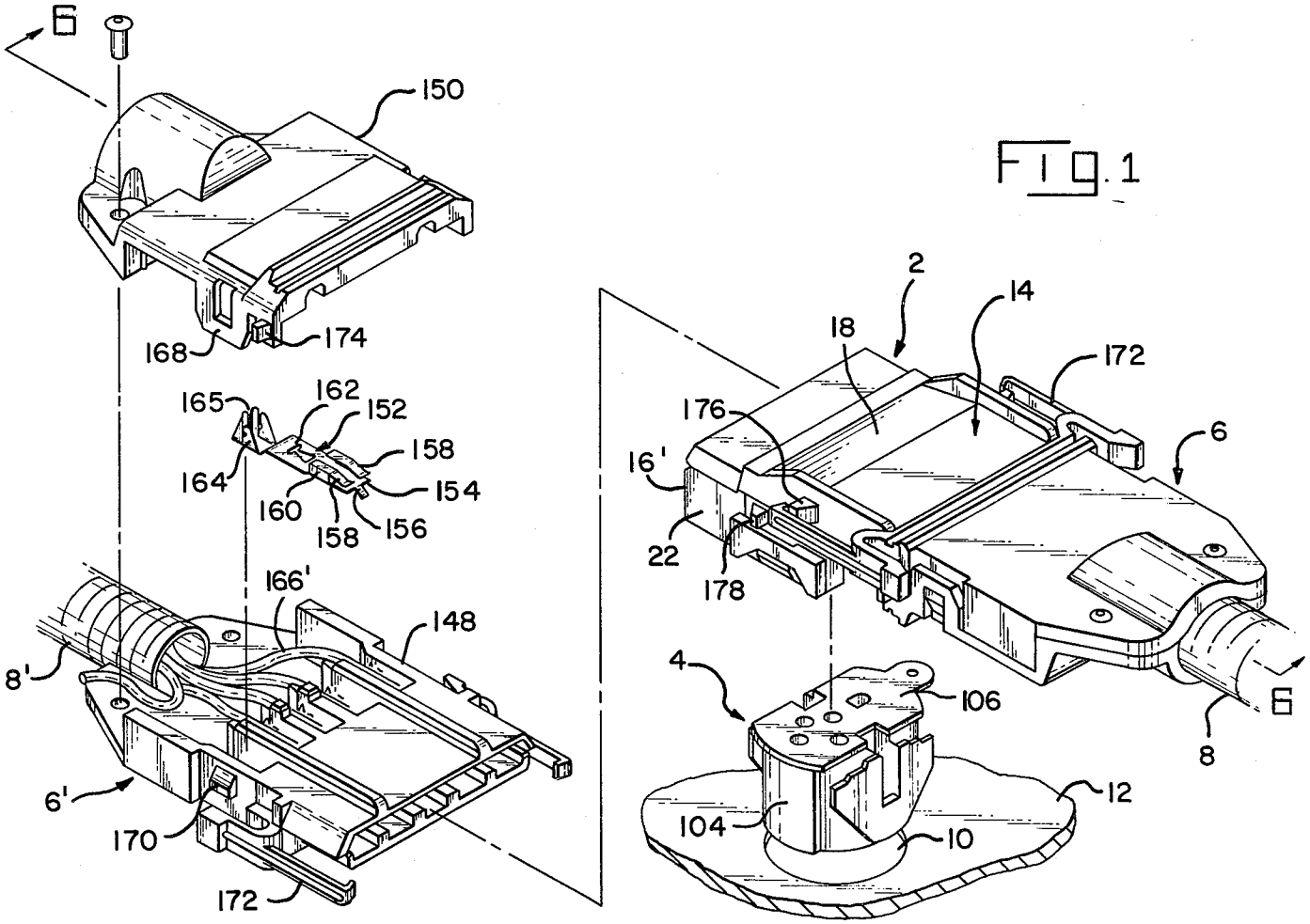
FIG. 1 is a perspective view showing a junction connector in accordance with the invention in alignment with a tap connector mounted in a circular opening in a panel and showing cable connectors of a type which can be mated with the junction connector.
Figure 2:
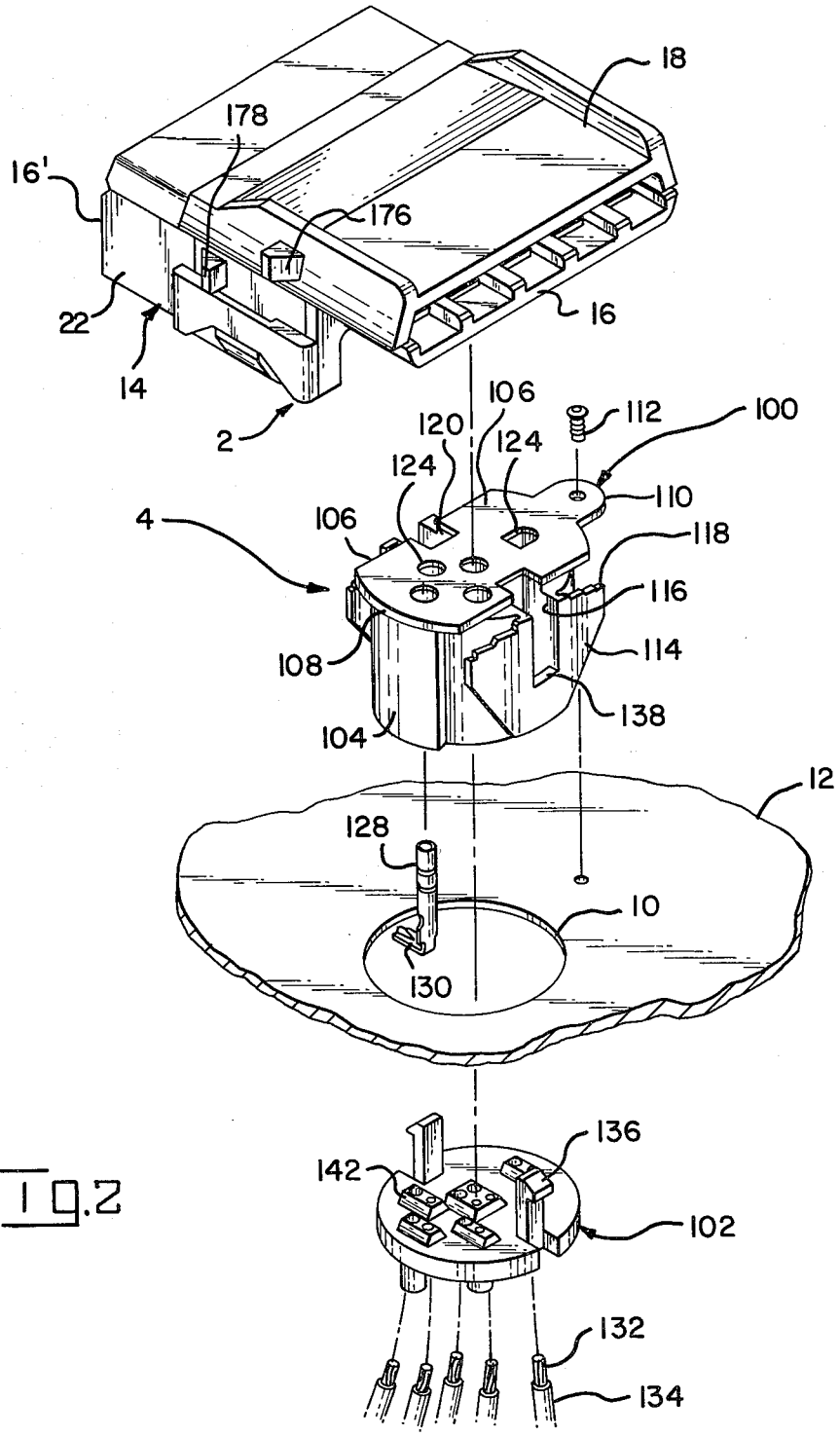
FIG. 2 is a perspective exploded view showing the junction connector above the tap connector and showing the tap connector exploded from the circular opening in a panel.

FIG. 1 shows a junction connector 2 and a tap connector 4 in accordance with the invention, the junction connector being coupled to one cable connector 6 installed on the end of a cable 8. The second cable connector 6' is exploded from the junction connector and parts of the cable connector are exploded to show details thereof. The junction connector 2 is exploded from, and in alignment with, the tap connector 4 which is mounted in circular opening 10 of a panel 12 which may be, for example, the panel of a fluorescent lighting ceiling fixture. The cable connectors 6, 6' are of the type described and claimed in application Ser. No. 233,543 filed Feb. 11, 1981 and are described below only to the extent necessary for an understanding of the present invention. It is pointed out, however, that the principles of the instant invention do not require the particular cable connectors 6, 6' shown, but can be used with any other types of connectors in modular wiring systems.

The junction connector 2 comprises a housing assembly 14 having oppositely directed cable connector receiving faces 16, 16'. Upper and lower sidewalls 18, 20 and oppositely directed endwalls 22 extend between the two faces. The lower sidewall 20 has projecting portions, the surface 24 of which serves as the tap connector receiving face, as will be described below.

Figure 3:
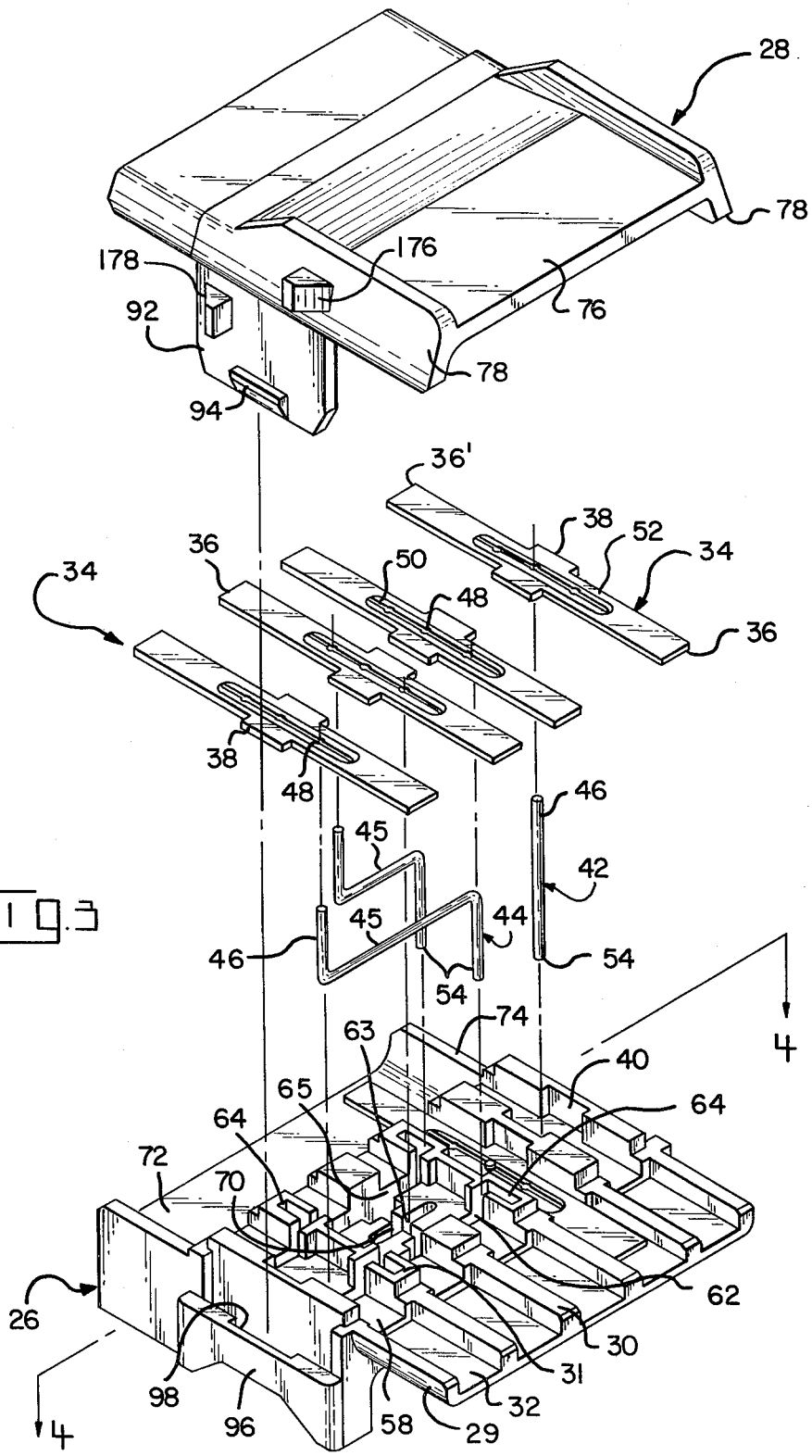
FIG. 3 is a perspective exploded view showing the parts of the junction connector.

The housing assembly 14 comprises a base or body 26 and a cover 28, both of which are preferably of a high quality thermoplastic material such as a suitable polycarbonate composition. As shown in FIG. 3, the righthand portion of the connector body 26 has a upwardly facing surface upon which are provided spaced-apart barriers 30 which define side-by-side stalls 32 which in turn receive feed-through conductors 34. The barriers 30 have raised portions 31 which are inwardly spaced from the mating face 16 and the inner surfaces of the stalls 32 are also elevated, as shown at 58.

The feed-through conductors 34 are extremely simple flat stamped members of conductive metal having ends 36, 36' which serve as cable terminals in the junction connector and which are mated with terminals 152 contained in the cable connectors 6, 6'. Each conductor 34 is enlarged midway between its ends, as shown at 38, and the stalls are correspondingly enlarged as shown at 40 so that after assembly of the conductors 34 to the housing, they cannot be moved axially from their installed positions. The tap conductors, which extend from the feed-through conductors to the terminals in the tap connector comprise rigid rods or stiff wires 42, 44, the conductors 42 being straight and the conductors 44 having a laterally extending intermediate portions 45.

Figure 7:
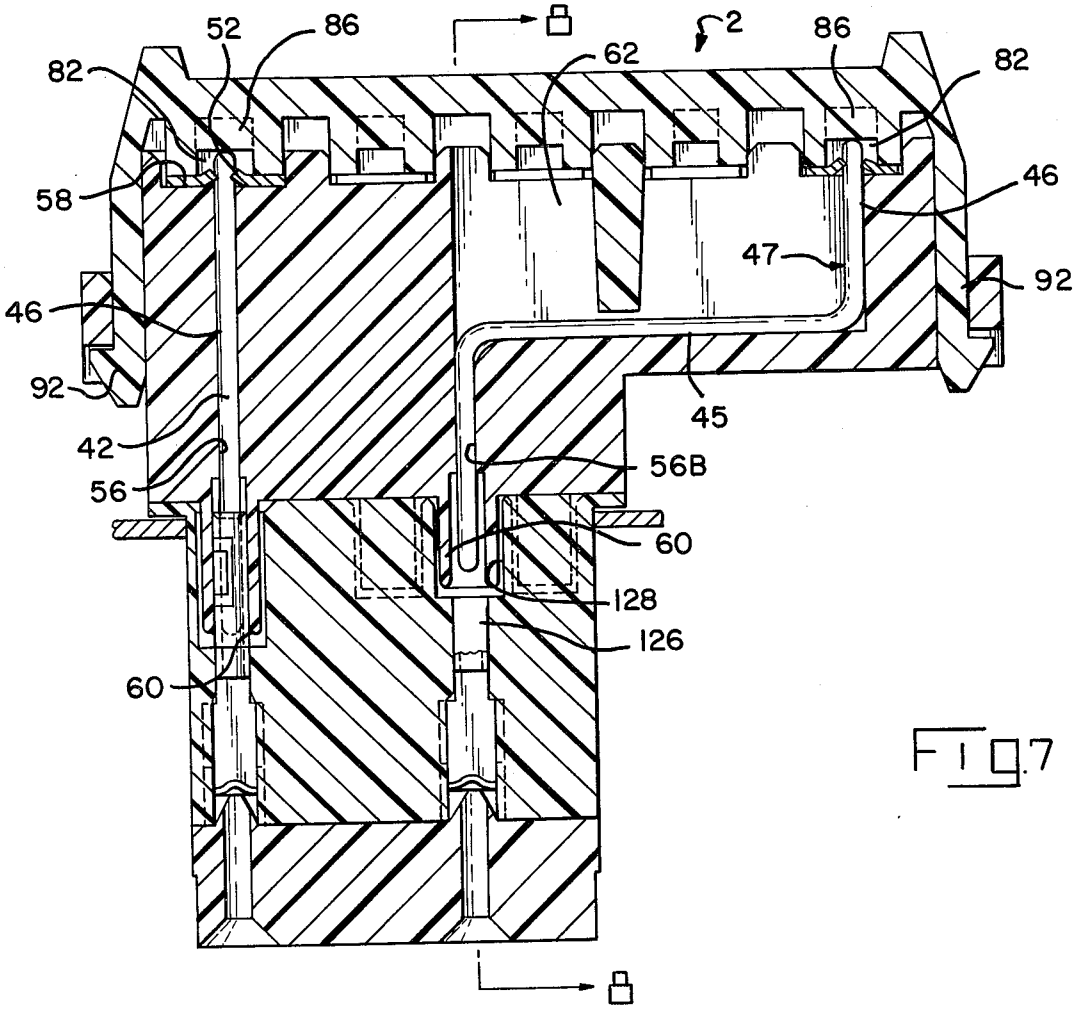
FIG. 7 is a cross-sectional view of FIG. 4 on an enlarged scale showing portions of the tap connector and the tap connector receiving face of the junction connector.

The first or upper ends 46 of the tap conductors 42, 44 are received in undersized openings 48 in the feed-through conductors 34. Three such openings 48 are provided in each conductor 34 and narrow slots 50 extend between these openings and beyond the openings at the ends of the line of openings. As shown in FIG. 7, the material on each side of each slot 50 and each opening 48 is formed upwardly, as viewed in the drawing and as shown at 52. The openings 48 receive the ends 46 of the tap conductors 42, 44, as also shown in FIG. 7. The formed up sections in the feed-through conductors 52 provide resilient contact between the upper ends of the tap conductors and the feed-through conductors. The tap conductors can be connected to the feed through conductors by merely forcing the ends 46 through the appropriate openings 48 with the aid of a suitable simple fixture.

The lower ends 54 of the tap conductors 42, 44 extend through holes, as shown at 56, in the housing body. The holes 56 extend from the inner surfaces of the stalls 58 to projections 60 which extend from the mating face 24, see FIG. 6. These projections and the holes 56 are arranged as a cluster, as clearly shown in FIG. 1, rather than in a row, as the feed-through conductors 34 are arranged. This cluster arrangement of the lower ends 54 of the tap conductors is possible by virtue of the provision of the intermediate offset portions 45 of the conductors 44.

The intermediate offset portions 45 of the conductors 44 are received in recesses, as shown at 62, 63, 65 which extend into the body portion and which extend transversely of the stalls 30, see FIG. 7. One end of each recess is located in alignment with one of the holes, as shown at 56B in FIG. 7, so that the lower end of the conductor 44, shown in FIG. 7, can then extend through the corresponding hole in the housing body. The upper end 46 of the same conductor extends from the recess 62 at the righthand end of the recess and into the through conductor 34 positioned in the associated stall 32.

Figure 4:
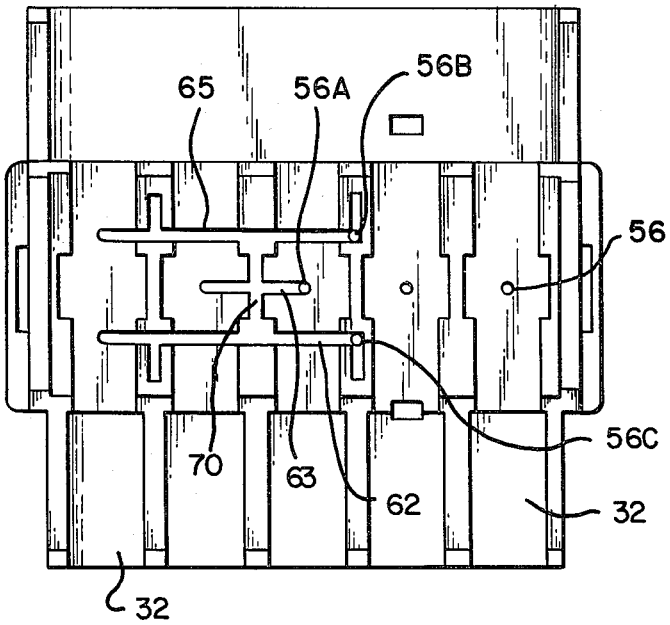
FIG. 4 is a plan view looking in the direction of the arrows 4—4 of FIG. 3 of the internal surface of the body portion of the junction connector housing.

As shown in FIG. 4, the through conductors 34 which are positioned in the two stalls 32 in the lefthand portion of the housing body are connected to tap conductors 44. These tap conductors 44 will then extend through one of the openings indicated at 56A, 56B, or 56C. In this manner, the side-by-side feed-through conductors in the junction connector are connected to terminals arranged as a non-linear cluster in the tap connector 4. The intermediate portions 45 of the tap conductors 44 are held in the recesses 62, 63, 65 by means of clamping members 66, 68 which extend downwardly from the underside of the housing cover 28. The ends of these clamping members extend into the recesses and the clamping members 66 also extend into laterally extending bays 64 of the recesses 62, 65. It will be noted from FIG. 5 that the clamping members 66 are generally T-shaped in cross-section and these bays 64 are therefore required to accommodate the stiffening ribs. The I-shaped clamping member 68 is received in an I-shaped recess 70, FIG. 4, and serves to clamp the conductor in the recess 63.

The lefthand portion of the housing base as viewed in FIG. 3, comprises a hoodlike section 72 which extends beneath the lefthand ends of the stalls 32 and which has arcuately extending flanges 74 at its side edges. This hoodlike portion extends over the lefthand ends 36' of the feed-through conductors 34.

Figure 5:
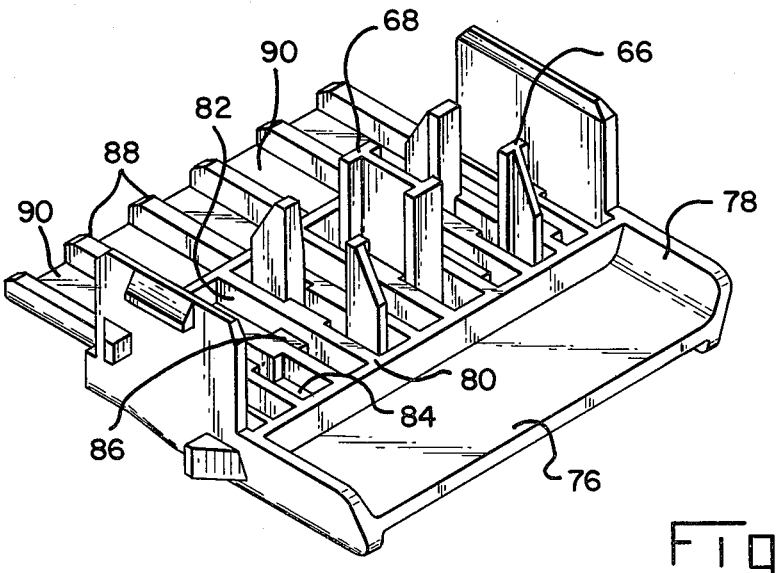
FIG. 5 is a perspective view showing the internal surface of the cover member of the junction connector housing.
Figure 5:
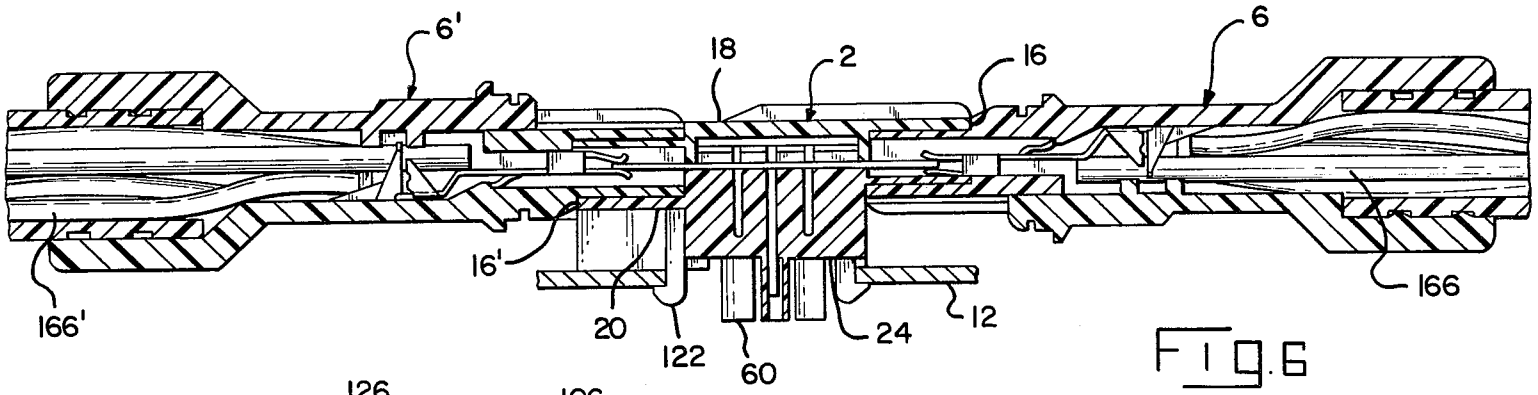

Referring now to FIG. 5, the cover member 28 has a hoodlike portion 76 at its righthand end having flanges 78 extending from its side edges. When the cover member is assembled to the base, this hood portion 76 extends over the righthand ends of the stalls 32 of the housing base. The central section of the cover on the underside thereof has a raised surface as viewed in FIG. 5, as shown at 80, which is against the upper surfaces of the feed-through conductors 34 and which therefore clamps these conductors in their respective stalls 32. Recesses 82, 84 extend into this raised central section, the recesses 82 having central bosses therein 86, which function as stops for the upper ends 46 of the tap conductors as shown in FIG. 7.

The lefthand end, as viewed in FIG. 5, of the cover member has spaced-apart barriers 88 thereon which are similar to the previously described barriers 30 and between these barriers there are stalls 90 for the ends 36' of the feed-through conductors. The cover member 28 is assembled to the housing base by passing latch arms 92 which depend from the side edges of the cover member through openings 98 defined by U-shaped locking members 96 on the endwalls of the housing base. The latch arms 92 have upwardly facing shoulders 94 on their outwardly facing surfaces which bear against the lower edges of the locking members 96 as shown in FIG. 1.

The tap connector 4 comprises a housing body 100 and a lower cover member 102 which is disposed against the downwardly facing surface of the body. The housing body has cylindrical surface portions 104 which conform to the panel opening 10 and has a mating face 106 on its upper surface which extends laterally beyond the cylindrical surfaces 104 as shown at 108. These flanges 108 thus project or extend beyond the edges of the opening 10 and assist in maintaining the housing in the opening. Additionally, an ear 110 may be provided on the upper surface so that a screw 112 can be passed through an opening in the ear and threaded into an opening in the panel 12.

The tap connector is also retained in the opening 10 by means of flexible locking ears 114 that are joined to the side surfaces of the housing by flexible connecting sections 116. The upper edges of the locking ears 114 are stepped, as shown at 118 to accommodate panels 12 of varying thickness. The housing is thus assembled to the panel 12 by merely passing it through the opening with accompanying inward flexure of the ears 114. After the housing is fully installed, the edges 118 will bear against the underside of the panel.

Openings 120 extend through the housing on opposite sides thereof for the accommodation of latch arms 122 which extend from the junction connector housing body, as shown in FIG. 6. The ends of these latch arms 122 are outwardly directed and engage the downwardly facing surface of the panel 12 so that the junction connector is latched to the panel independently of the tap connector.

A plurality of terminal receiving cavities 124 extend through the tap connector from the upper surface or mating face 106 thereof to the lower end of the tap connector housing. These cavities have enlarged diameter upper end portions 120 which are dimensioned to receive the cylindrical projections 60 extending from the tap connector receiving face 24 of the junction connector. It will be noted from FIG. 1, that one of these cavities is non-circular and the corresponding projection is also non-circular, an arrangement which gives the technician a visual indicator of the proper orientation for coupling of the connectors to each other.

Figure 8:
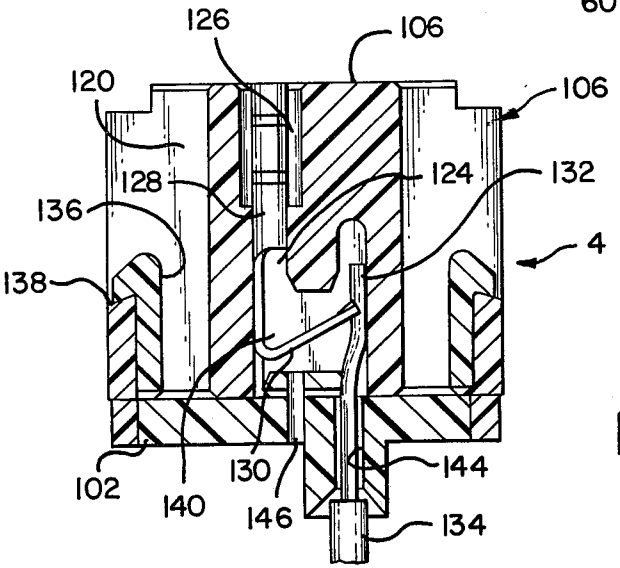
FIG. 8 is a cross-sectional view taken along the line 8—8 of FIG. 7 of the tap connector showing details of the contact terminals contained therein.

The contact terminals 128 which are contained in the tap connector housing have tubular upper portions which are dimensioned to receive the ends 54 of the tap conductors, as shown in FIG. 7. At their lower ends, these terminals have laterally extending wire contacting portions 130 which are received in the enlarged lower ends 140 of the cavities in the tap connector housing. The stripped ends 132 of the wires 134 are connected to the terminals in the tap connector by inserting the ends of the wires through wire admitting passageways 144 in the bottom cover 102. If the wire is pushed upwardly, as viewed in FIG. 8, the stripped end 132 flexes the contact portion 130 of the terminal until the contact portion resiliently bears against and captures the wire. If it is necessary to release a wire 134, a small rod can be inserted through an opening 146 in the cover 102 so that the contact portion 130 can be pushed upwardly from the portion shown in FIG. 8 thereby releasing its grip on the wire and permitting withdrawal of the wire.

The cover member 102 has latch arms 136 which extend into the previously identified openings 120 and the upper ends of which engage shoulders 138 on the sides of the openings 120. The surface of the cover member has a plurality of bosses 142 thereon which are dimensioned to fit into the lower ends of the terminal receiving cavities in the tap connector housing accurately to position the tap member on the housing body.

The cable connectors 6 and 6' each comprise a housing body 148 and a housing cover 150, the body containing a plurality of electrical contact terminals 152. Each terminal has a contact portion 154 consisting of a tongue 156 and in spaced relationship thereto a pair of contact springs 158 which are integral with the side edges of the tongue as shown at 160. The contact terminal also has an intermediate flat web portion 162 and a wire receiving portion 164 provided with a slot 165 for reception of the cable conductors 166. The cover member 150 is latched to the housing body 148 by means of suitable latching arms shown at 168, which cooperate with latch ears 170 on the base.

As previously mentioned, tap connectors and junction connectors in accordance with the invention can be dimensioned and designed to be used with cable connectors other than the type shown in the drawing and described in the above identified application Ser. No. 233,543 filed 2/11/81 now U.S. Pat. No. 4,405,192. Tap and junction connectors in accordance with the invention can also be provided with through conductors and tap conductors other than those shown herein. It is an advantage, however, that the through conductors and the tap conductors are rigid members which can be produced by stamping and forming in standard configurations to provide any combination of electrical taps to the distribution conductors 166, 166' in the distribution cables. The particular through conductors 34 and tap conductors 42, 44 described above and shown in the drawing are described more fully and claimed in application Ser. No. 249,519 filed Mar. 31, 1981. The connectors 6, 6' are provided with latch arms 172 and latch ears 174 and are of the hermaphroditic type, in that each connector can be mated with an identical connector when the two connectors are in the opposed inverted relationship. The cable connectors 6, 6' are coupled to the junction connector 2 by means of the latch arms 172 and ears 176, 178 on the cover member and the body of the junction connector, as shown in FIG. 1.

A significant advantage of the invention is that the feed-through conductors 34 in the junction connector which are in side-by-side parallel relationship can be connected to terminals 54 in the tap connector 4 which are arranged as a cluster within the cylindrical tap connector housing. The tap connector can therefore be dimensioned such that it can readily be mounted in the standard diameter openings 10 which are provided in many types of electrical equipment. A further advantage of the invention is that with a limited number of different parts, through conductors and tap conductors 42, 44, any of the through conductors can be connected to any of the terminals 128 in the tap connector for different type circuits.

Finally, it is distinctly advantageous that the parts of the housings of the connector are entirely of high quality plastic which are easily assembled to each other, and it is unnecessary to use metal shells in surrounding relationship to the plastic housings.

What is claimed is:

1. An electrical junction connector which is intended for use in a power distribution system of the type comprising distribution cables having cable conductors therein, cable connectors on the ends of said cables, junction connectors at the electrical junctions in said system, and tap connectors, said cable connectors and said tap connectors being coupled to said junction connectors, said junction connector comprising a junction connector housing having oppositely directed cable connector receiving faces and having a tap connector receiving face, said housing having cable connector terminals therein proximate to said cable connector receiving faces and having tap connector terminals therein proximate to said tap connector receiving face, said cable terminals being mateable with complementary cable terminals in said cable connectors, said tap terminals being mateable with complementary tap terminals in said tap connector, said tap terminals being selectively connected to said cable terminals to provide tap connections to said cable conductors, said junction connector being characterized in that:

said junction connector housing has a plurality of side-by-side parallel feed-through conductors therein extending between said cable connector receiving faces, said cable terminals being on the ends of said feed-through conductors, said housing has a plurality of rigid tap conductors therein, each of said tap conductors having a first end which is connected to one of said feed through conductors, said tap conductors extending from said feed-through conductors to said tap connector receiving face and having said tap terminals on their ends, at least one of said tap conductors having an intermediate portion which extends laterally of said first and second ends whereby said second end is parallel to, and offset from, said first end, and said second ends are arranged in a cluster at said tap connector receiving face.

2. An electrical junction connector as set forth in claim 1, said feed-through conductors being in coplanar relationship.

3. An electrical junction connector as set forth in claim 2, said housing having oppositely directed external sidewalls and oppositely directed external endwalls, said tap connector receiving face being on one of said sidewalls, said housing having panel mounting means thereon for mounting said housing on one surface of a panel with said tap connector receiving face in alignment with an opening in said panel.

4. An electrical junction connector as set forth in claim 3, said housing comprising a base portion and a cover member, said one sidewall being on said base portion, said base portion having parallel channels extending thereacross between said cable connector receiving faces, each of said feed-through conductors being positioned in one of said channels.

5. An electrical junction connector as set forth in claim 4, said base portion having openings therein extending normally of the axes of said feed-through conductors, said openings extending to said top connector receiving face, each of said tap conductors extending through one of said openings.

6. An electrical junction connector as set forth in claim 5, said base portion having at least one recess therein extending transversely of said channels, said recess having one end thereof in alignment with one of said openings, said intermediate portion of said one tap conductor being in said recess, said second end of said one tap conductor extending through said one opening to said tap connector receiving face.

7. An electrical junction connector as set forth in claim 6 said base portion having a plurality of said recesses therein.

8. An electrical junction connector and a tap connector, said junction and tap connector being intended for use in a power distribution system of the type comprising distribution cables having cable conductors therein, cable connectors on the ends of said cables, junction connectors at the electrical junctions in said system, and tap connectors, said cable connectors and said tap connectors being coupled to said junction connectors, each junction connector comprising a junction connector housing having oppositely directed cable connector receiving faces and having a tap connector receiving face, said housing having cable connector terminals therein proximate to said cable connector receiving faces and having tap connector terminals therein proximate to said tap connector receiving face, said cable terminals being mateable with complementary cable terminals in said cable connectors, said tap terminals being mateable with complementary tap terminals in said tap connector, said tap terminals being selectively connected to said cable terminals to provide tap connections to said cable conductors, said junction connector and said tap connector being characterized in that:

said junction connector housing has a plurality of side-by-side parallel feed-through conductors therein extending between said cable conductor receiving faces, said cable terminals being on the ends of said feed-through conductors, said junction connector housing has a plurality of rigid tap conductors therein, each of said tap conductors having a first end which is connected to one of said feed-through conductors, said tap conductors extending from said feed-through conductors to said tap connector receiving face and having said tap terminals on their ends, at least one of said tap conductors having an intermediate portion which extends laterally of said first and second ends whereby said second end is parallel to, and offset from, said first end, and said second ends are arranged in a cluster at said tap connector receiving face, said tap connector comprises a generally cylindrical tap connector housing which is dimensioned to be mounted in a circular panel opening, said tap connector having said complementary tap terminals therein arranged in a cluster which matches said cluster of said second ends of said tap conductors.

9. An electrical junction connector and a tap connector as set forth in claim 8, said housing having oppositely directed external sidewalls and oppositely directed external endwalls, said tap connector receiving face being on one of said sidewalls.

10. An electrical junction connector and a tap connector as set forth in claim 9, said tap connector housing having mounting means for mounting said tap connector housing in said opening in said panel.

11. An electrical junction connector and a tap connector as set forth in claim 9, said tap connector housing having a mating face which is against said tap connector receiving face of said junction connector when said tap connector and said junction connector are coupled, said tap connector housing having mounting means thereon for mounting said tap connector in said panel opening with said mating face on one side of said panel, said junction connector having latch arm means for latching said junction connector to said panel when said connectors are coupled.

12. An electrical junction connector and a tap connector as set forth in claim 11, said latch arms extending from said one sidewall, said tap connector receiving face being between said latch arms.

13. An electrical junction connector and a tap connector as set forth in claim 12, said tap connector housing comprising a base portion and a cover member, said one sidewall being on said base portion, said base portion having parallel channels extending thereacross between said cable connector receiving faces, each of said feed-through conductors being in one of said channels.

14. An electrical junction connector and a tap connector as set forth in claim 13, said base portion having openings therein extending normally of the axes of said feed-through conductors, said openings extending to said tap connector-receiving face, each of said tap conductors extending through one of said openings.

15. An electrical junction connector and a tap connector as set forth in claim 14, said base portion having at least one recess therein extending transversely of said channels, one of said openings communicating with said recess, said intermediate portion of said one tap conductor being in said recess, said second end of said one tap conductor extending through said one opening to said tap connector receiving face.

* * * * *